US007166788B2

(12) United States Patent
Wyman

(10) Patent No.: US 7,166,788 B2
(45) Date of Patent: Jan. 23, 2007

(54) STRINGED MUSICAL INSTRUMENT

(76) Inventor: Kevin Alexander Wyman, 2248 N. 74th Way, Scottsdale, AZ (US) 85257

( * ) Notice: Subject to any disclaimer, the term of this patent is extended or adjusted under 35 U.S.C. 154(b) by 68 days.

(21) Appl. No.: 11/034,167

(22) Filed: Jan. 12, 2005

(65) Prior Publication Data

US 2005/0150346 A1 Jul. 14, 2005

Related U.S. Application Data

(60) Provisional application No. 60/536,183, filed on Jan. 12, 2004.

(51) Int. Cl.
*G10D 3/00* (2006.01)

(52) U.S. Cl. ..... 84/291

(58) Field of Classification Search ..... 84/290, 84/294, 267, 291

See application file for complete search history.

(56) References Cited

U.S. PATENT DOCUMENTS

| | | | | |
|---|---|---|---|---|
| 3,974,730 | A * | 8/1976 | Adams, Jr. | 84/291 |
| 6,376,755 | B1 * | 4/2002 | Kammerer | 84/290 |
| 6,943,283 | B1 * | 9/2005 | McPherson | 84/291 |

OTHER PUBLICATIONS

Carruth, Alan, "Fine Tuning", 2000, 6 pages.

The Classical Guitar Book, Jan. 8, 2005 (date retrieved from the Internet), 3 pages, (Retrieved from the Internet <URL: http://www.morrish.dircon.co.uk/classical.html).

Fletcher, Neville H. and Rossing, Thomas D., *The Physics of Musical Instruments*, 2nd ed., Springer-Verlag, New York, 1998 Chap. 9, "Guitars and Lutes", pp. 239-270.

Gough, Colin, "Science and the Stradivarius", *Physics World*, Apr. 2000, 9 pages.

Guild® Gear / Acoustics / GAD-JF30, Jan. 8, 2005 (date retrieved from the Internet), 2 pages, (Retrieved from the Internet <URL http://www.guildguitars.com/gear/gear.php?partno=3813000).

Polettipiano, Reproducing the Sounds of Ancient Instruments, Jan. 8, 2005 (date retrieved from the Internet), 5 pages, (Retrieved from the Internet <URL: http://www.polettipiano.com/Pages/air_modes.html).

Fernandezmusic, The Traditional Spanish Method of Classical Guitar Construction, Jan. 8, 2005 (date retrieved from the Internet), 4 pages, (Retrieved from the Internet <URL: http://www.fernandezmusic.com/Trad.%20Spanish%20Method.html).

U.S. Appl. No. 60/536,183 for Kevin Alexander Wyman entitled "Wyman Instrument", filed Jan. 12, 2004.

* cited by examiner

*Primary Examiner*—Kimberly Lockett
(74) *Attorney, Agent, or Firm*—Altera Law Group, LLC

(57) ABSTRACT

A family of stringed musical instruments has improved tonal quality. The top plate is cylindrically curved parallel to the strings, and the back plate is cylindrically curved along an axis perpendicular to the strings. The transverse braces supporting the top plate are scalloped, leaving substantial air gaps along the glue line once the brace is attached. The back plate is supported by a substantial longitudinal brace, or spine, which runs down its center parallel to the strings. The spine contains a substantial portion of the mass of the back plate. The spine and braces are produced as a laminate, with spruce surrounding a core of ebony. These musical instruments have improved harmonic generation over common instruments, and therefore have a more complex and pleasing tone than common instruments. In addition, there is little spatial variation for the harmonics produced by these musical instruments.

23 Claims, 9 Drawing Sheets

STRINGED MUSICAL INSTRUMENT

CROSS-REFERENCE TO RELATED APPLICATIONS

This application claims the benefit of U.S. Provisional Application No. 60/536,183 filed Jan. 12, 2004 (K. A. Wyman, Wyman instrument), which is hereby incorporated herein in its entirety by reference thereto.

BACKGROUND OF THE INVENTION

1. Field of the Invention

The present invention is directed to stringed musical instruments, and more particularly to stringed musical instruments with improved harmonic generation.

2. Description of the Related Art

An important characteristic of a musical instrument is its tone. A tone may be considered as a particular combination of a fundamental frequency and accompanying harmonics, each with a particular amplitude and phase. The combination of these harmonics gives an instrument its tone. For instance, an "A" note played on a violin will sound different from an "A" note played on a guitar, even though both "A" notes have a fundamental frequency of 440 Hz, because a violin has a different characteristic tone from a guitar. Likewise, a pure sine wave at 440 Hz, which has no accompanying harmonics, will sound different from an "A" played on either a violin or a guitar. Put simply, it is the harmonics accompanying each note that give an instrument its characteristic sound, or tone. In general, the more harmonics that accompany each note, the more complex the tone of the instrument, and the more pleasing the sound that is perceived by the listener.

In the early history of stringed instruments, the volume emitted from an instrument typically was not great. An instrument might have been played in the court of a member of royalty, and only need have produced enough sound for the handful of people that might have been present. As time passed, and the venues for music increased in size to modern day concert halls, the required volume from musical instruments increased as well. Instruments evolved to be louder, producing more volume and allowing their sound to project into larger and larger venues. For stringed instruments, the way to produce a louder sound was to increase the string tension and use a larger acoustical cavity and playing table.

Although the newer stringed instruments were indeed louder, they suffered from a simplicity of tone. For example, the modern-day guitar may produce enough sound to reach the back row of a large concert hall, but the sound it produces is dominated by its fundamental frequency, and is largely devoid of the accompanying strong harmonics that would increase the richness of its tone. Some might say that the modern-day stringed instruments lack the richness in tone that was present in their predecessors, despite being much louder than their predecessors. In addition, the newer instruments suffered from a lack of sustain, which is the desirable "ringing" of an instrument after a note is played.

Many of the stringed instruments, both antiquated and current, have several elements in common. The strings are fastened on the top side of the instrument, and generally extend along a neck. The tension of each string is adjustable at one or both ends, so that the instrument may be tuned. The strings are mechanically coupled by a bridge to a top plate, which is sometimes called a playing table. Typically, the top plate is substantially flat, although it may be domed or arched in places with respect to a coplanar edge, and may optionally have one or more holes in it that allow air to pass into and out of the instrument. Opposite the top plate is a back plate, which is also typically flat and with its mass substantially evenly distributed, although it too may be domed or arched in places with respect to a coplanar edge. While the back plate may be made from a single piece of wood, typically it is made from two pieces that are glued together, and the glue joint is reinforced by strips or cleats of soft and light wood. Braces normal to the seam and running between the strips or cleats may be used to improve the structural integrity of the back plate. The top plate and the back plate are joined at their perimeters by a rib or ribs. Typically the rib is produced as a long, thin, rectangular piece of wood veneer or laminate of essentially constant width and thickness, which is bent into shape to trace the outline of the top and back plates, and glued. Once secured, the rib is substantially perpendicular to both the top and back plates along the entirety of both seams.

Although modem stringed instruments individually lack rich and complex tonal color, pleasing tonal color may be achieved in an acoustically correct concert hall when essentially identical instruments identically tuned are played with precision by professional musicians. Unfortunately, differences between instruments of the same type and their tuning, as well as the understandable limitations of many non-professional musicians, result in the poor tonal color experienced in many performances.

Accordingly, there exists a need for a stringed instrument that has the volume level of modern-day instruments, but has an increased richness in tone, characterized by an increase in the harmonics that accompany each note. The stringed instrument should also have a large degree of sustain. Such a stringed instrument would be able to produce a richer, more complex sound than its current counterparts, while producing enough volume to adequately fill a large concert venue, thereby eliminating or reducing the need to rely on multiple instruments and the properties of the concert hall to achieve full tonal color.

BRIEF SUMMARY OF THE INVENTION

One embodiment of the present invention is a stringed musical instrument comprising a body comprising a first plate; a second plate; and a rib coupling the first and second plates to form a cavity enclosed by the first and second plates and by the rib, and vented through a hole in one of the first and second plates. The second plate comprises a concentrated mass continuously extending across the second plate between a first section of the rib and a second section of the rib, and having ends in proximity to respectively the first and second rib sections; a first distributed mass extending from the concentrated mass to a third section of the rib between the first and second rib sections; and a second distributed mass extending from the concentrated mass to a fourth section of the rib between the first and second rib sections, the first rib section being between the third and fourth rib sections, and the second rib section being between the third and fourth rib sections. The instrument further comprises a plurality of strings; and a bridge acoustically coupling the strings to one of the first and second plates.

Another embodiment of the present invention is a stringed musical instrument comprising a body comprising a first plate; a second plate; and a rib coupling the first and second plates to form a cavity enclosed by the first and second plates and by the rib, and vented through a hole in one of the first and second plates. The second plate comprises an elongated supportive portion extending across the second plate between a first section of the rib and a second section of the rib, and having ends in proximity to respectively the first and second rib sections. Portions of the second plate disposed away from the elongated supportive portion, the first plate, and the rib are all capable of sustained vibration over a broad spectrum of resonance modes. The instrument further comprises a plurality of strings; and a bridge acoustically coupling the strings to one of the first and second plates.

Another embodiment of the present invention is a stringed musical instrument comprising a body comprising a first plate; a second plate; and a rib coupling the first and second plates to form a cavity enclosed by the first and second plates and by the rib, and vented through a hole in one of the first and second plates. The second plate comprises a plurality of resonant structures tuned to predetermined resonances, the resonances being related in accordance with a diatonic scale and the resonant structures being substantially independent of one another at the resonances. The instrument further comprises a plurality of strings; and a bridge acoustically coupling the strings to one of the first and second plates.

Another embodiment of the present invention is a stringed musical instrument comprising a body comprising a first plate curved to form a first generally convex surface having a first crest line and a first generally concave surface; a second plate curved to form a second generally convex surface having a second crest line and a second generally concave surface; and a rib coupling the first and second plates to form a cavity enclosed by the first and second generally concave surfaces and by the rib, and vented through a hole in one of the first and second plates. The first crest line is transverse to the second crest line. The instrument further comprises a plurality of strings; and a bridge acoustically coupling the strings to one of the first and second plates.

Another embodiment of the present invention is a stringed musical instrument comprising a body comprising a first plate; a second plate; a rib coupling the first and second plates to form a cavity enclosed by the first and second plates and by the rib, and vented through a hole in one of the first and second plates; and a brace extending across a portion of the first plate within the cavity, the brace having a plurality of interspersed projecting sections along an edge thereof and being secured to the first plate by the projecting sections, wherein portions of the edge between the projecting sections are spaced away from the first plate. The instrument further comprises a plurality of strings; and a bridge acoustically coupling the strings to one of the first and second plates.

Another embodiment of the present invention is a stringed musical instrument having a longitudinal axis and comprising an elongated body having a neck end and a bottom end and comprising a playing table comprising a first sheet of wood of generally a first predetermined density having a generally cylindrical curvature to form a first generally convex surface having a first substantially straight crest line and a first generally concave surface, the first crest line being generally parallel to the longitudinal instrument axis; a back having a generally cylindrical curvature to form a second generally convex surface having a second substantially straight crest line and a second generally concave surface, the second crest line being generally perpendicular to the longitudinal instrument axis; a rib glued to the first and second plates at respective undulating seams to form a cavity enclosed by the first and second generally concave surfaces and by the rib, and vented through a hole in the playing table; a neck block disposed at the neck end of the elongated body and glued to the playing table, the back, and the rib; a bottom block disposed at the bottom end of the elongated body and glued to the playing table, the back, and the rib; and a playing table brace glued to and extending across a portion of the playing table within the cavity, the first playing table brace having a scalloped edge in contact with the playing table and extending across the playing table in conformance with the curvature thereof and perpendicular to the first crest line. The back comprises a second sheet of wood of generally a second predetermined density greater than the first density; and a back brace glued to and extending entirely across the second sheet of wood in conformance with the curvature of the back and within the cavity, the back brace being and perpendicular to the second crest line and having an edge in continuous contact with the back and in conformance with the curvature of the back, and the back brace being a laminated material having a continuous core of a third density greater than the second density. The instrument further comprises a neck glued to the neck block and acoustically coupled to the back brace, the neck having a fingerboard thereon and a head stock at an end thereof; a plurality of strings having first and second ends, the first ends of the strings being mechanically coupled to the playing table and the second ends of the strings running along the fingerboard and being mechanically coupled to the head stock; and a bridge acoustically coupling the strings to the playing table.

DETAILED DESCRIPTION OF THE INVENTION

The sound produced by a musical instrument is highly dependent on the instrument's construction, including the choice of materials, the size, shape and placement of the components, and the way in which the components are attached. All of these elements contribute to the overall tone of an instrument. For instance, a particular wood may be used in a certain element of an instrument based on the wood's strength, density, tensile strength, and so forth. By altering a particular component, one may affect the overall tone of the instrument.

For instance, one may alter the back plate of an instrument by redistributing its mass, so that some locations on the plate have more mass, while other locations have less mass. Consider, for example, a back plate where a substantial fraction of its mass is concentrated along the longitudinal axis of the plate. Such a back plate could be made by using a thin sheet of material for the back plate itself, and attaching a strip of relatively dense material along the "spine" of the back plate (i.e., bisecting the back plate, parallel to the strings). If one wished to match the particular mass of the back plate of a known instrument, the back plate and spine may be designed so that the overall mass of the back plate remains essentially unaltered.

This modification of the back plate, with a substantial fraction of its mass located along its central axis, profoundly affects the performance of the instrument. For example, the "spine" of the instrument provides structural support for the instrument. In contrast with many common stringed instruments, in which a substantial amount of support between top and back plates is provided by one or more of the plates and by a rib that connects the plates along the perimeter of the instrument, an instrument with a substantial "spine" would get increased support from the spine itself, and would rely less on the rib and plates, typically the back plate, for structural support. With a substantial spine, the top and back plates would be less anchored at their edges (along the rib), and more anchored from the center (along the spine). This shift in structural duties away from the rib and a plate would leave the rib more free to vibrate along with the top and back plates, which tends to result in a louder instrument. Furthermore, because the rib itself is more free to vibrate, the sound produced by the instrument is more free to exit the instrument through the sides of the instrument, which tends to result in a more directionally uniform output for the instrument. In addition, placing a substantial portion of the mass of the back plate along its center tends to aid in the production of harmonics by the instrument symmetrically about the spine, which gives a more pleasing overall tone.

Figure 7:
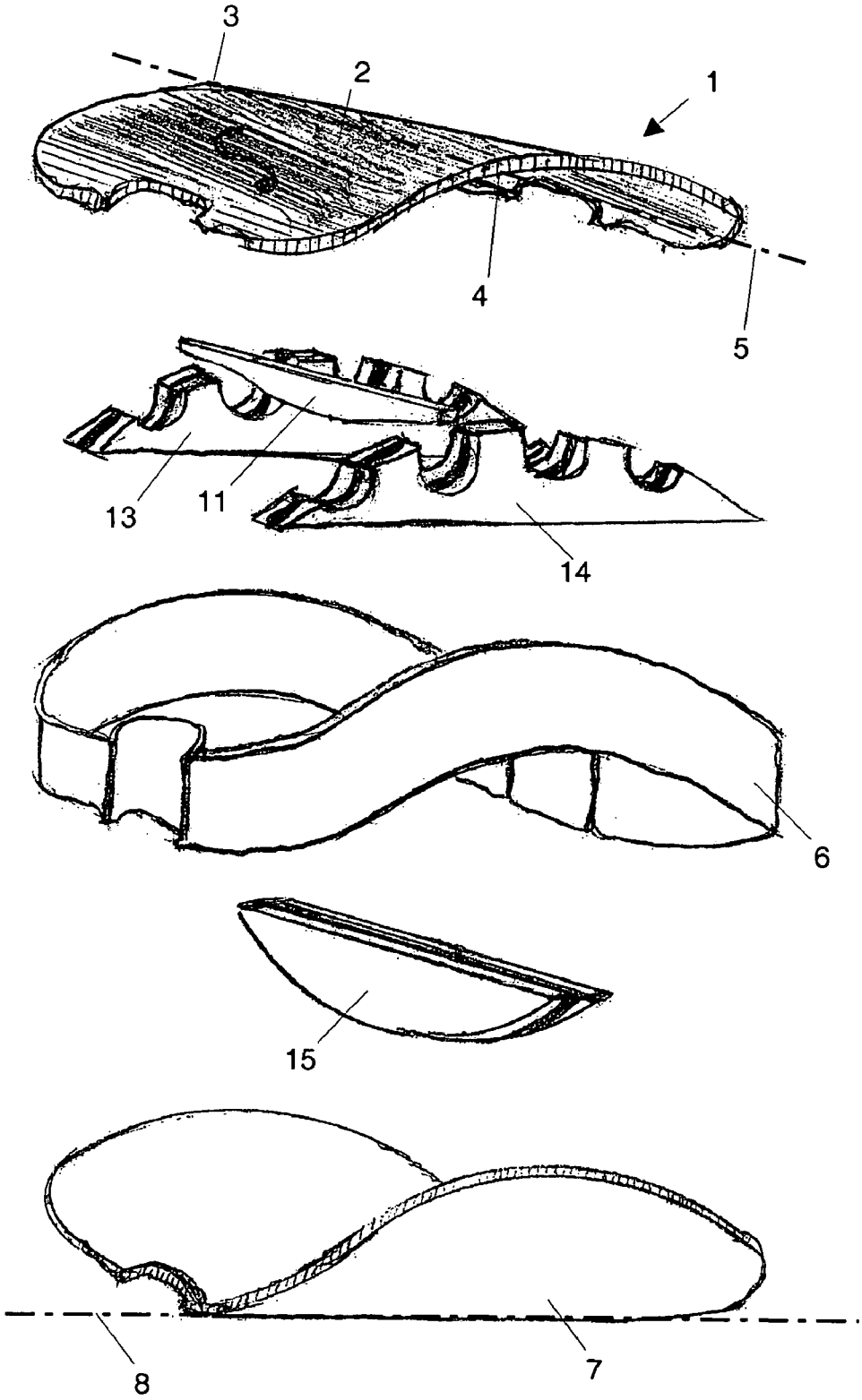
FIG. 7 is an exploded view drawing of a violin.

Another alteration to an instrument includes the addition of curvature to both the top and back plates themselves without constraining their edges to a plane. The top plate, for example, may have a generally cylindrical curvature, with a crest that is parallel to the longitudinal axis of the instrument, which is typically parallel to the strings. As an example, FIG. 7 shows a top plate 2 of a violin 1, which has a straight crest line 5 between the neck end 3 and lower end 4 of the top plate 2, parallel to the strings (not shown). The cylindrical curvature of the top plate may be oriented so that the farther away from the strings one goes, the closer to the back plate one gets; in other words, the "center" of the assembled instrument would be thicker than its "edges". This cylindrical curvature provides a focusing effect to the sound waves inside the instrument; sound energy that reflects off the cylindrically curved top plate is concentrated toward the center of the back plate, along its spine. The exact amount of concentration would depend on its radius of curvature and the distance to the back plate. Note that the curvature may be aspheric or conical in nature, but preferably is least curved along the longitudinal direction of the top plate.

Similarly, the back plate may have a generally cylindrical curvature as well, but preferably is oriented perpendicularly to the curvature of the top plate, so that points along the back plate near the center of the instrument are farther away from the front plate than points closer to or farther away from the neck of the instrument. FIG. 7 shows a back plate 7, with a straight crest line 8 oriented perpendicularly to the straight crest line 5 of the top plate 2. The cylindrical curvature of the back plate would also have a focusing effect on the sound waves inside the instrument, dependent on the radius of curvature. Similarly, the curvature may be aspherical or conical in nature, but preferably is least curved along the direction of the top plate normal to the longitudinal.

While cylindrical curvatures of the top and back plates are preferred, the curvatures may vary from cylindrical in any desired manner. In addition, the crest lines may alternatively be curved.

As a result of the orthogonal cylindrical curvatures of the top and back plates, the rib that connects the plates along their perimeters intersects the front and back plates over a substantial amount of the seams at angles other than 90°. This non-orthogonal intersection is desirable for the instrument, in that a non-90° seam is less rigid than a 90° seam, and allows the seam and the rib to flex more with the vibrations of the instrument. This tends to produce a louder output, and tends to allow more of the sound to escape from the sides of the instrument, desirably producing a more omnidirectional output for the instrument.

Figure 1:
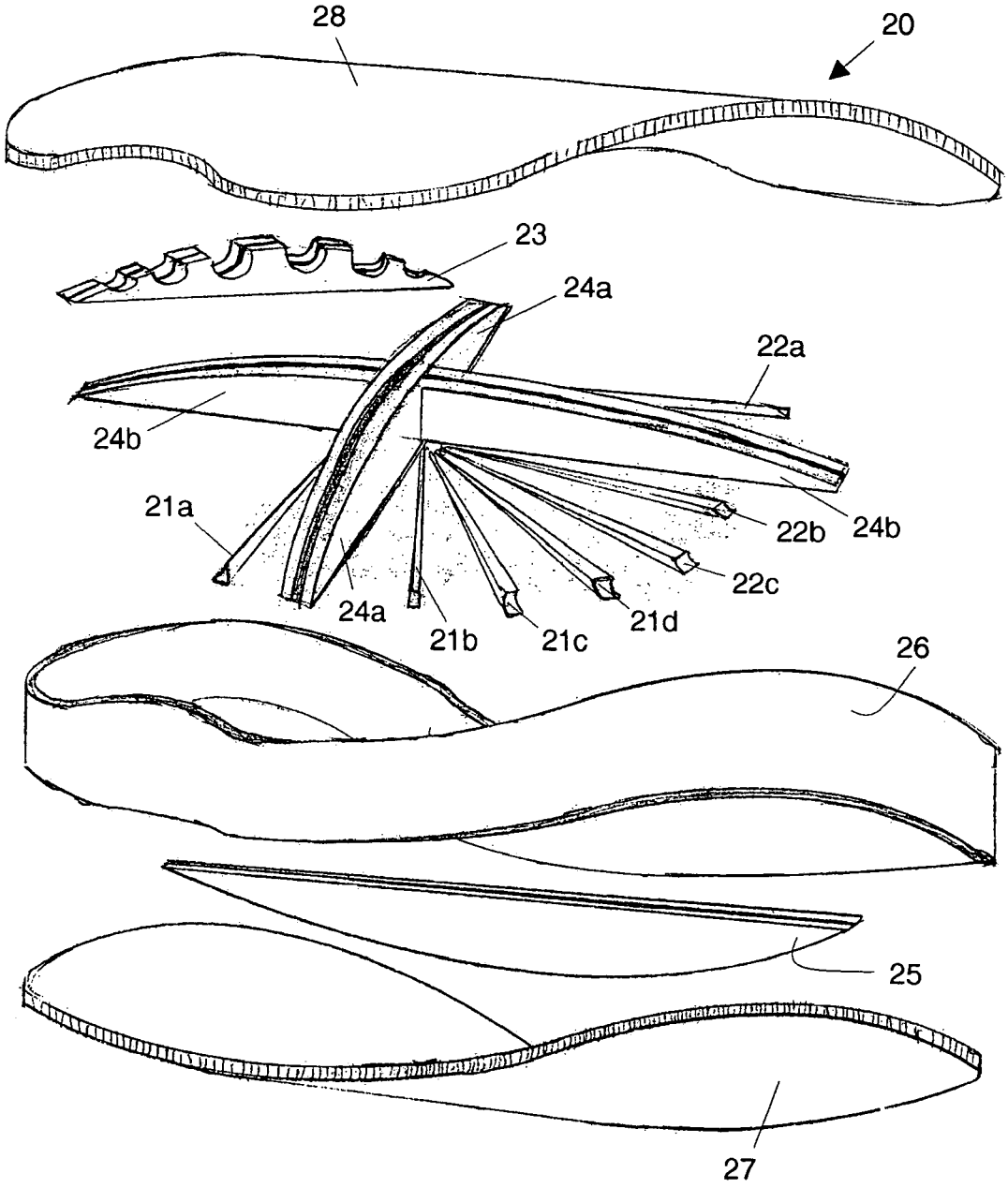
FIG. 1 is an exploded view of an acoustic guitar.

A further alteration to an instrument is the introduction of scalloped braces. Typically, braces are not scalloped where they contact a plate of an instrument. Consider the known use of braces on a top plate. Because a typical brace is continuous, it forms a boundary along the top plate, undesirably separating the top plate into two regions divided by the brace. By introducing scallops into the bracing used in places other than the longitudinal center of the back plate, the boundary between the two regions is reduced, and the tone of the instrument is enhanced. An example of a scalloped brace is shown in FIG. 1, where the upper transverse brace 23 is scalloped. Note that the curved side, which contains the scallops, is the side in contact with the top plate 28 of the instrument. The side opposite the scalloped side faces into the interior cavity of the instrument 20. Further examples of scalloped braces are the upper transverse brace 13 and lower transverse brace 14 shown in FIG. 7. The curved sides of these braces are in contract with the top plate 2, and the sides opposite the curved sides face into the interior cavity of the instrument.

In general, each of the techniques described above may be applied to a variety of stringed musical instruments, including guitars, violins, violas, cellos, mandolins, and others. The effect of the modifications is to increase the harmonics produced by the instrument, giving a more complex and more pleasing tone. In many cases, the overall volume of sound produced by the instrument is also increased. These amplified harmonics are generally radiated more uniformly from the instrument, with less directional dependence than typical instruments.

FIG. 1 shows an exploded view of a guitar 20. The strings, although not shown, would appear at the upper end of FIG. 1, and would be directly adjacent to the top plate 28, which is sometimes called a playing table. Attached to the underside of the top plate 28 is an upper transverse brace 23. The upper transverse brace 23 has a curved side with scallops, which supports the top plate 28 when the instrument is assembled. Opposite the scalloped side is a generally flat side, which faces into the acoustic cavity in the interior of the guitar. Also in contact with the underside of the top plate 28 is a cross brace 24, denoted by crossed elements 24*a* and 24*b*. The cross brace 24 also supports the shape of the top plate 28 when the instrument is assembled, and may also be called an X brace. In a radial pattern among the cross brace 24 are a series of treble tone bars 22*a–c* and bass tone bars 21*a–d*. The tone bars are also attached to the underside of the top plate 28, but are smaller than the cross brace 24 and play an acoustic, rather than a supportive, role in the guitar 20. Attached to the perimeter of the top plate 28 is a rib 26, which may also be referred to as a side. The rib 26 connects the top plate 28 and its attached elements 21–24 to the back plate 27 and a longitudinal brace 25 that is attached to the back plate 27.

The materials described below are discussed in the context of a guitar, but are generally applicable to any of the stringed instruments described herein. Note also that any of the instruments described herein may use any of the bracing schemes described herein, such as the X brace, or one or two transverse braces, or any other suitable bracing scheme.

The top plate 28 is preferably a sheet of spruce. Spruce is a preferred wood because it is generally light, and grows such that lines of its grain are exceptionally straight. As a result, it carries acoustic tones very well, and is an outstanding choice for the top plates of many stringed instruments. In general, the spruce is used so that its grain lines run from the top of the instrument (near the neck) to the bottom of the instrument (opposite the neck).

The upper transverse brace 23 is typically formed as a laminated wood structure. In the figures, a laminate is represented schematically by a "sandwich" construction, in which two light-colored woods surround a dark-colored wood core. In reality, the colors of the wood need not correspond to those of FIG. 1, and any suitable woods may be used. The preferred laminate structure for any of the stringed musical instruments described herein is a spruce exterior, flanking a core of ebony. Ebony is a very dense wood, and has excellent tensile strength. The presence of spruce on both sides of the ebony reduces the joint stress once the brace is glued in place. In addition, the presence of spruce in the laminate preserves the tonal quality of the instrument, since spruce is the preferred wood used for the top plate. The upper transverse brace 23 may be attached to the top plate 28 with an epoxy, glue, or other suitable bonding material. The upper transverse brace 23 has scallops, which leave substantial air gaps along the glue line when the brace is attached to the top plate 28. These air-filled scalloped regions may allow the top plate 28 to more easily deform along its longitudinal axis while generating resonant harmonic modes, thereby acting as acoustic viaducts allowing acoustic energy to access the outer regions of the surface of the top plate 28.

Similarly, the cross brace 24 is also a wood laminate, and is attached to the top plate 28 in a similar manner as the upper transverse brace 23. As discussed above, the preferred choice for the laminate is an ebony core surrounded by spruce.

The bass tone bars 21 and treble tone bars 22 are typically strips of spruce. Although the tone bars are shown in a radial pattern in FIG. 1, any suitable pattern may be used.

The rib 26 is preferably made from a single piece of a "tone wood", which is a category of hard woods that are commonly used for musical instruments. The tone woods include maple, mahogany, and rosewood. The rib 26 allows for acoustic energy to couple efficiently between the top and back plates of the guitar 20. Note that if the top and back plates were completely flat, then the unfolded rib would be completely rectangular in profile. But because the top and back plates have their own curvatures and because the edges of the top and back plates are not constrained to parallel planes, the rib 26 assumes the wiggly shape shown in FIG. 1. Furthermore, the height of the rib 26 varies at different locations along the perimeter of the guitar 20. Note that the rib may be constructed in a piecewise fashion in sections that are joined during construction of the instrument. Note that although the word rib is used in a singular fashion to include the combination of a left rib and a right rib. The left rib and right rib may be manufactured from discrete pieces.

The longitudinal brace 25 may be referred to as a spine, and preferably runs from the neck end to the lower end of the back plate 25. It, too, is formed preferably as a laminate with an ebony core surrounded by spruce. The mass of the longitudinal brace 25 preferably is substantial compared to that of the back plate 27, so that a substantial portion of the mass of the back structure is located along its spine, in the middle of the back plate, parallel to the strings. Preferably, the longitudinal brace 25 accounts for approximately 15–20% of the combined weight of the back plate 27 and the longitudinal brace 25. However, instruments may be made in which the longitudinal brace 25 accounts for somewhat less, somewhat more, or even considerably more of the combined weight of the back plate 27 and the longitudinal brace 25. Percentages of as much as 30–35% or even more may be used in some types of instruments. The longitudinal brace 25 is attached to the upper surface of the back plate 27 with an epoxy, glue, or other suitable adhesive.

The back plate 27 itself is typically made from the same material as the rib, preferably one of the tone woods. Because the back plate 28 is supported by the longitudinal brace 25, it may be made uniformly thinner than is typical of the back plate in the common guitar, and the difference in mass may be shifted to the longitudinal brace 25, so that the mass is roughly the same between the back plate of the common guitar and the combination of the back plate 27 and the longitudinal brace 25 of the novel guitar 20. Keeping the mass roughly constant in this manner carries over some of the familiar acoustic properties of the common guitar to the current guitar 20. However, the combined mass of the combination of the back plate 27 and the longitudinal brace 25 may be varied from the mass of the back plate of the common guitar, if desired.

The novel back element, which is the back plate 27 with its attached longitudinal brace 25, has resonant patterns dramatically different from previous back plates, which enhance the tonal color and the projected sound level of the instrument.

Figure 2:
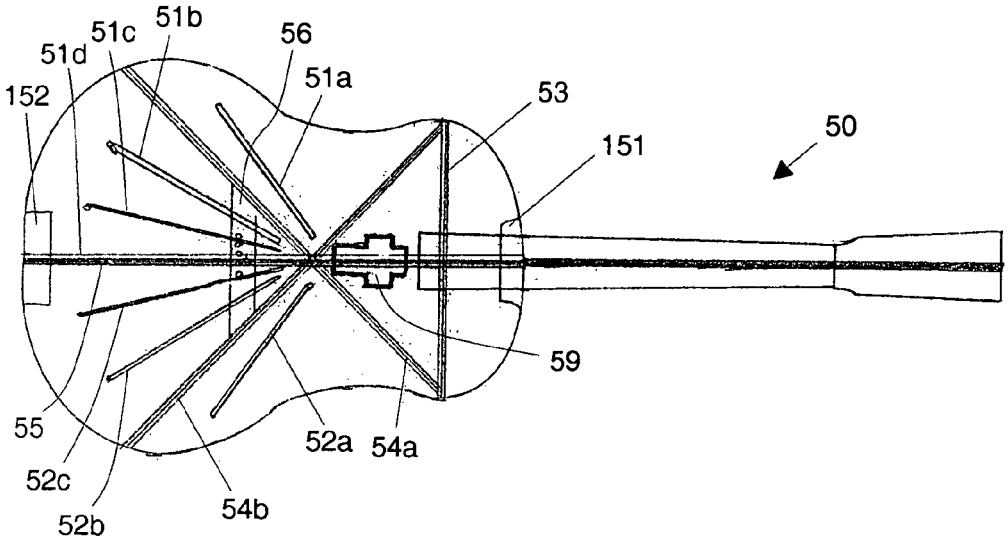
FIG. 2 is a top view of an acoustic guitar.
Figure 3:
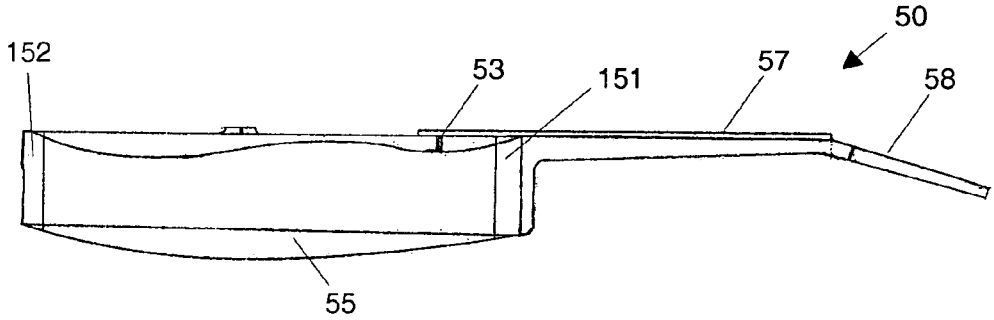
FIG. 3 is a right-side view of the acoustic guitar of FIG. 2.

FIGS. 2 and 3 show an assembled acoustic guitar 50. The bass tone bars 51 and treble tone bars 52 are attached to the underside of the top plate. The cross brace 54 and scalloped upper transverse brace 53 are also attached to the underside of the top plate. The longitudinal brace 55 is attached to the back plate. A bridge plate 56 attaches the strings to the top plate of the guitar 50. The top plate has a sound hole 59, which is not shown in FIG. 1. Likewise, FIGS. 2 and 3 show the neck 57 of the guitar 50, with the head stock 58. Illustratively, the neck 57 and head stock 58 form an angle of about 16.8°.

There is a neck block 151 and a bottom block or lower block 152, both preferably made of spruce, with the grain extending from the top plate to the back plate. The two blocks, not shown in the exploded view of FIG. 1, are common to the stringed instruments described herein, and play a largely structural role in the instruments. Typically, the neck connects to the body of the instrument at the neck block, which provides more support than if the neck were connected directly to the rib or to either plate. The lower block also provides support to the plates, and helps to relieve some of the tension on the top plate caused by the strings.

Both blocks are typically glued to both plates and to the rib. Preferably, both blocks are notched to receive the longitudinal brace, which extends into them and is glued there as well.

Figure 4:
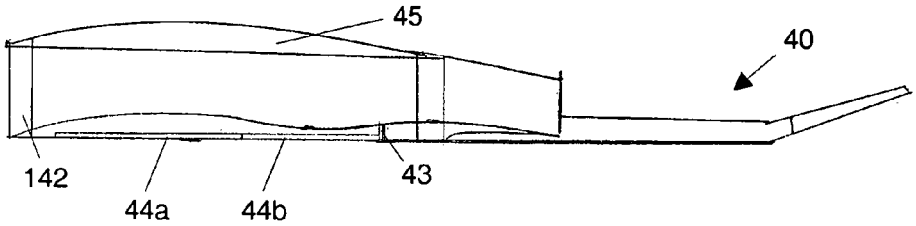
FIG. 4 is a left-side view of a cutaway acoustic guitar.
Figure 5:
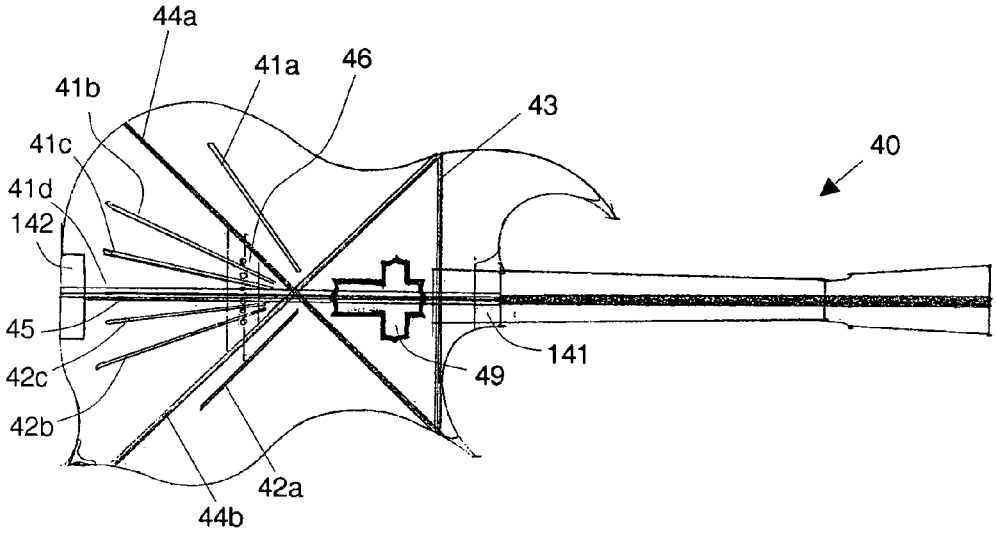
FIG. 5 is a top view drawing of the cutaway acoustic guitar of FIG. 4.
Figure 6:
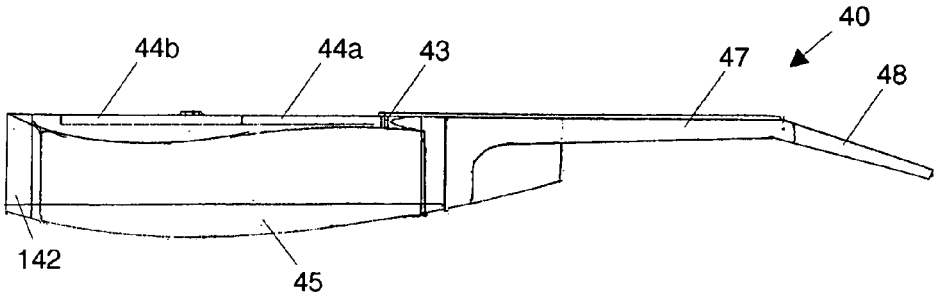
FIG. 6 is a right-side view of the cutaway acoustic guitar of FIGS. 4 and 5.

FIGS. 4–6 show different views of a cutaway guitar 40, named for the asymmetry of its body. Compared to the symmetric acoustic guitar 50 of FIGS. 2 and 3, the cutaway guitar 40 has a similar interior volume, but with an upper portion near the neck moved from one half to the other. Many of the other elements of the cutaway guitar 40 are similar to that of the acoustic guitar 50, including bass tone bars 41, treble tone bars 42, an upper transverse brace 43, a cross brace 44, a longitudinal brace 45, a bridge plate 46, a sound hole 49, a neck block 141 and a lower block 142. Illustratively, the neck 47 and head stock 48 are connected with an angle of about 18°.

Note that the two halves of the cutaway guitar 40 differ both in volume and in mass. However, advantageously the halves are tuned to respective tones of the diatonic scale. Just the right material is "removed" from one half and added to the other so that the resonance of the smaller half is preferably a third or fifth above the resonance of the larger half. This difference between the halves of the cutaway guitar 40 produces harmonics that tend to be further separated than the harmonics produced by a comparable symmetric guitar such as the acoustic guitar 50. This relatively large spectral separation between the harmonics and their fundamentals is nonetheless pleasing to the ear, and gives the cutaway guitar a different but no less rich tone.

FIG. 7 shows an exploded view of a violin 1. The violin 1 has many similarities to the guitar 20 of FIG. 1. The top plate 2, rib 6, longitudinal brace 15, and back plate 7 are similar in construction to the corresponding elements in the guitar 20, illustratively using identical materials and having generally the same function. As with the guitar, the top and back plates have a generally cylindrical curvature, with the cylindrical axis of one perpendicular to the cylindrical axis of the other. For the top plate 2, the cylindrical axis 5 is parallel to the strings, and for the back plate 7, the cylindrical axis 8 is perpendicular to the strings.

Several differences are seen in the form of the braces on the top plate, which provide structural support for the top plate, and the tone bars, which affect the tone of the instrument and do not play a structural role. The violin 1 has an upper transverse brace 13, similar in function and construction to the upper transverse brace 23 in the guitar 20. The upper transverse brace 13 is scalloped on the surface in contact with the top plate 2, leaving several substantial air gaps along the glue line, so that acoustic energy may pass more freely past the brace. The upper transverse brace 13 is mounted closer to the neck end 3 than the lower end 4. The violin 1 has a lower transverse brace 14, also scalloped, and similar in construction and function to the upper transverse brace 13, but located closer to the lower end 4 than the neck end 3. Note that the violin 1 uses two transverse braces on the top plate, in contrast with the guitar, which uses a transverse brace and a cross brace. All of the braces on the top plate for all the instruments herein use a laminated structure for the braces, with a high-density ebony core surrounded by spruce.

In contrast with the multiple tone bars used in the guitar 20, the violin 1 typically uses only a single bass tone bar 11, typically made of spruce. Note than the bass tone bar 11 may extend through the scallops in the transverse braces and therefore, may provide greater control over the acoustic properties than if unscalloped braces were used.

Figure 8:
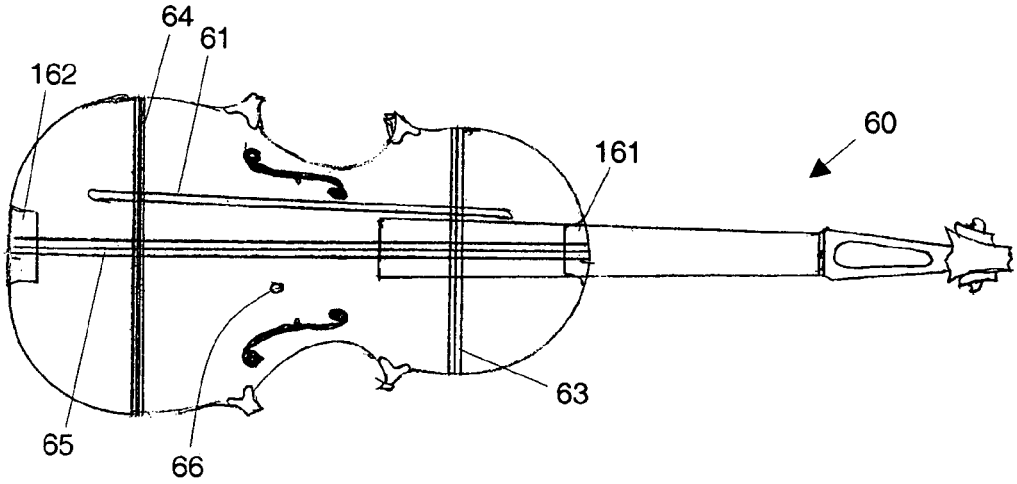
FIG. 8 is a top view drawing of a violin.
Figure 9:
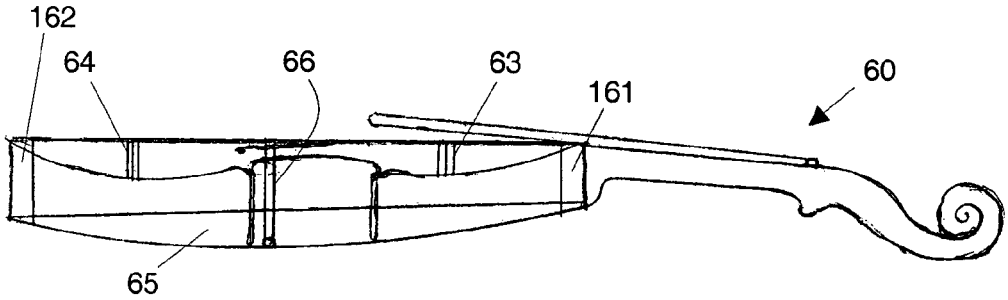
FIG. 9 is a right-side view drawing of the violin of FIG. 8.

FIGS. 8 and 9 show an assembled violin 60. The bass tone bar 61, upper transverse brace 63, lower transverse brace 64, and longitudinal brace 65 are all shown, and correspond to similar elements in FIG. 7. Unlike the guitar, the violin 60 has a sound post 66, typically made of spruce, which connects the top plate directly to the back plate, and is not shown in the exploded view of FIG. 7. The grain in the sound post 66 preferably extends from the front plate to the back plate. In contrast with the guitar, the top plate of the violin 60 uses two off-center "f-holes" rather than a single centered sound hole, as commonly seen in the guitar. The violin also has a neck block 161 and a lower block 162, which are not shown in FIG. 7.

Figure 10:
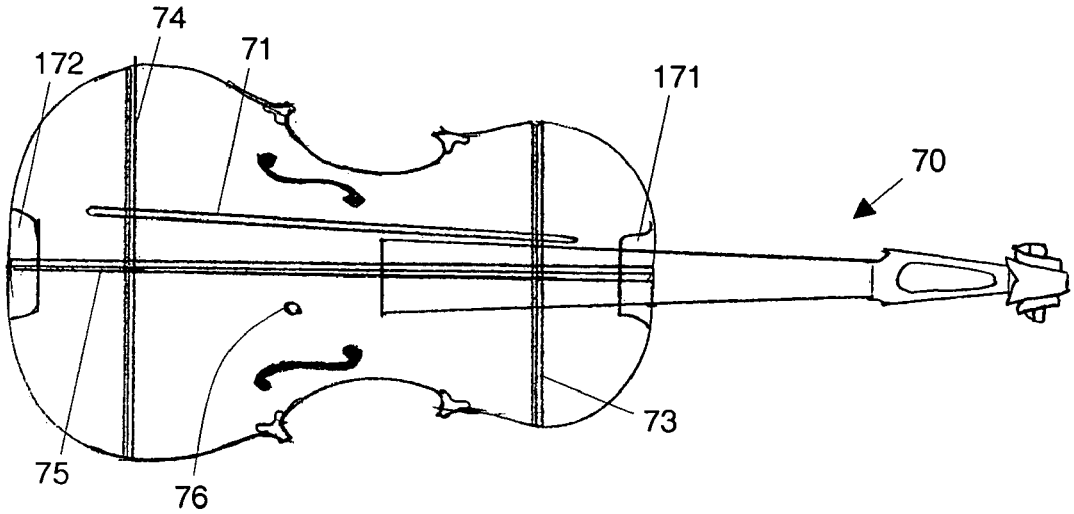
FIG. 10 is a top view drawing of a viola.
Figure 11:
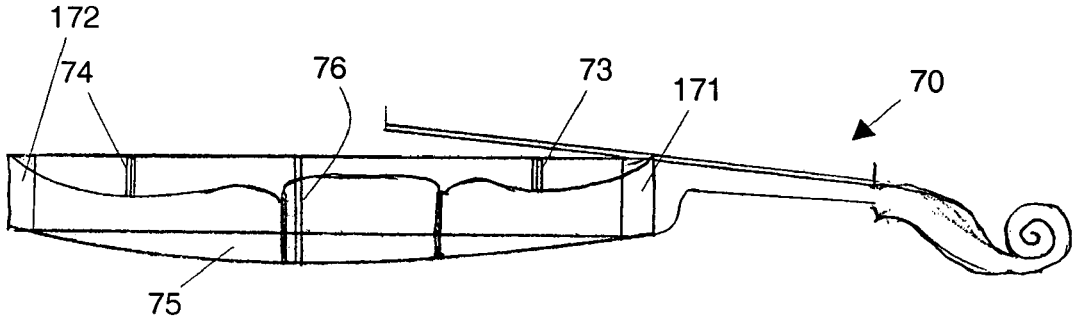
FIG. 11 is a right-side view drawing of the viola of FIG. 10.

FIGS. 10 and 11 show a viola 70. The viola 70 is larger than the violin 60 and has a deeper sound, but has a similar construction to the violin 60. The viola 70 also has a bass tone bar 71, upper transverse brace 73, lower transverse brace 74, longitudinal brace 75, sound post 76, neck block 171 and lower block 172. The materials and functions of these elements are essentially the same as the elements of the violin 60, but are all sized to accommodate the deeper sound of the instrument.

Figure 12:
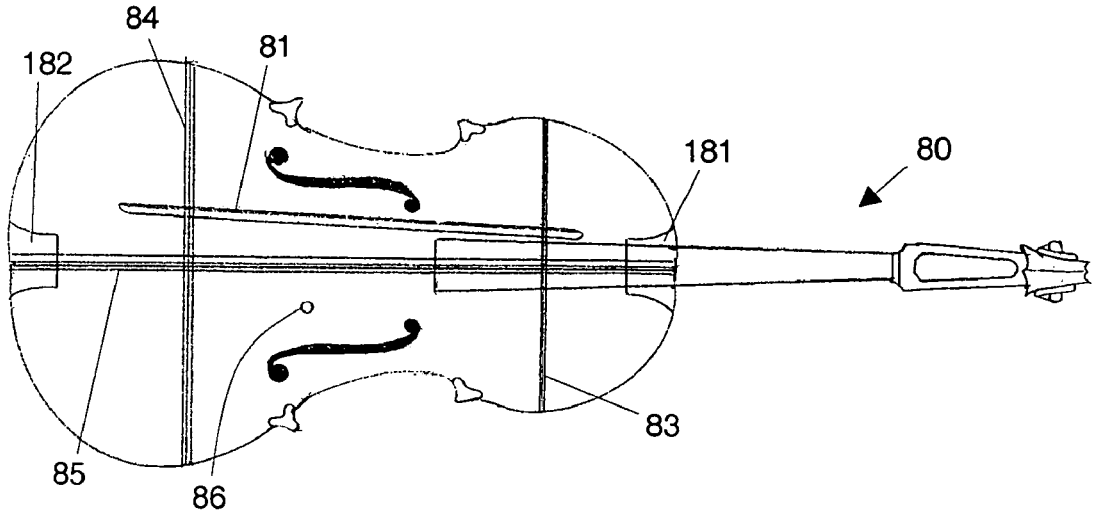
FIG. 12 is a top view drawing of a violincello.
Figure 13:
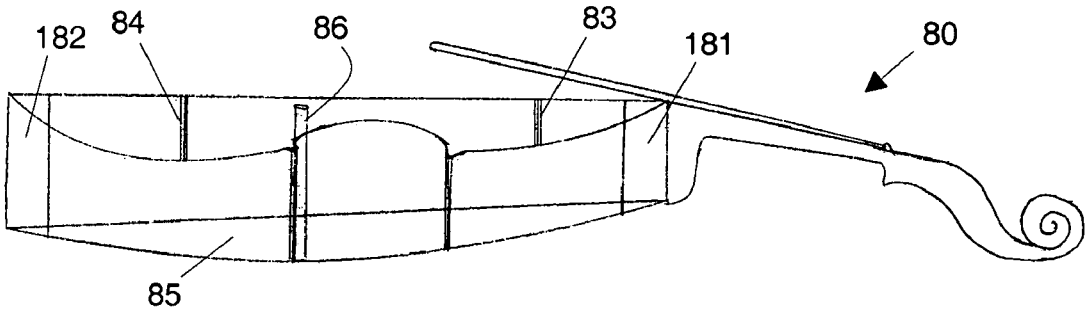
FIG. 13 is a right-side view drawing of the violincello of FIG. 12.

Even larger is the violincello 80, shown in FIGS. 12 and 13. It, too, has a bass tone bar 81, upper transverse brace 83, lower transverse brace 84, longitudinal brace 85, sound post 86, neck block 181 and lower block 182, with materials and functions are all essentially the same as the elements of the violin 60.

Figure 14:
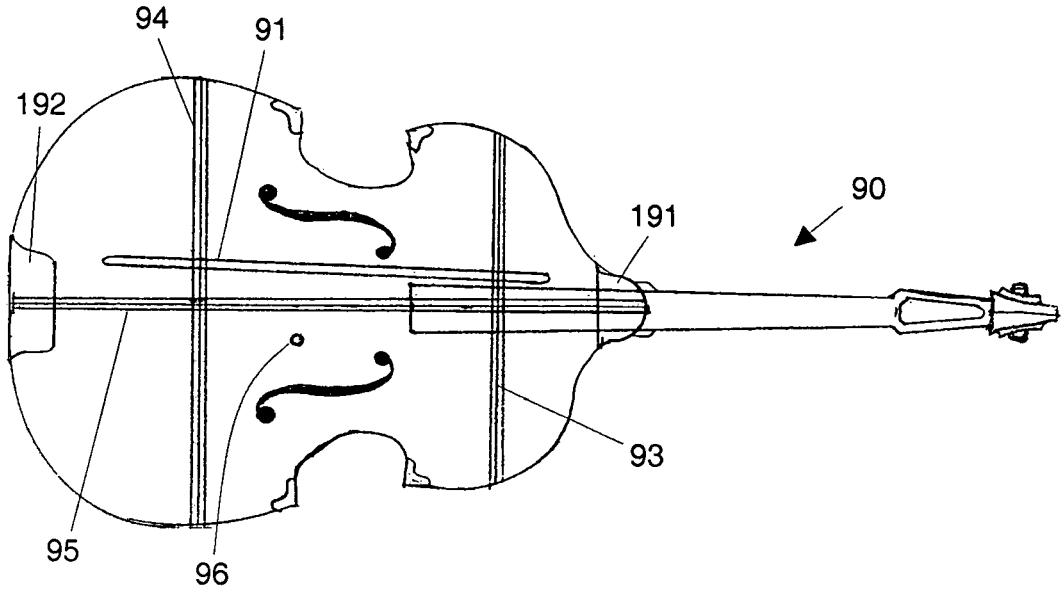
FIG. 14 is a top view drawing of a double bass violin/viol.
Figure 15:
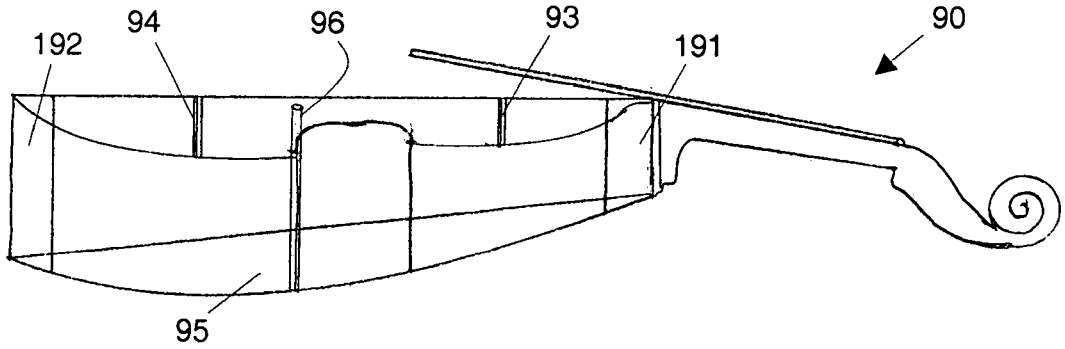
FIG. 15 is a right-side view drawing of the double bass violin/viol of FIG. 14.

Even larger than the violincello 80 is the double bass violin/viol 90, shown in FIGS. 14 and 15. It, too, has a bass tone bar 91, upper transverse brace 93, lower transverse brace 94, longitudinal brace 95, sound post 96, neck block 191 and lower block 192, with materials and functions are all essentially the same as the elements of the violin 60.

Figure 16:
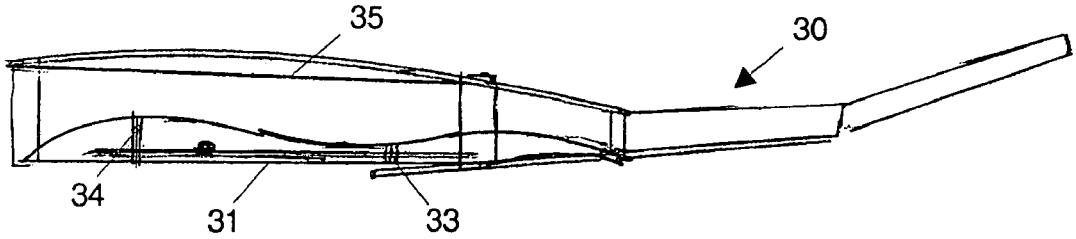
FIG. 16 is a left-side view drawing of a mandolin.
Figure 17:
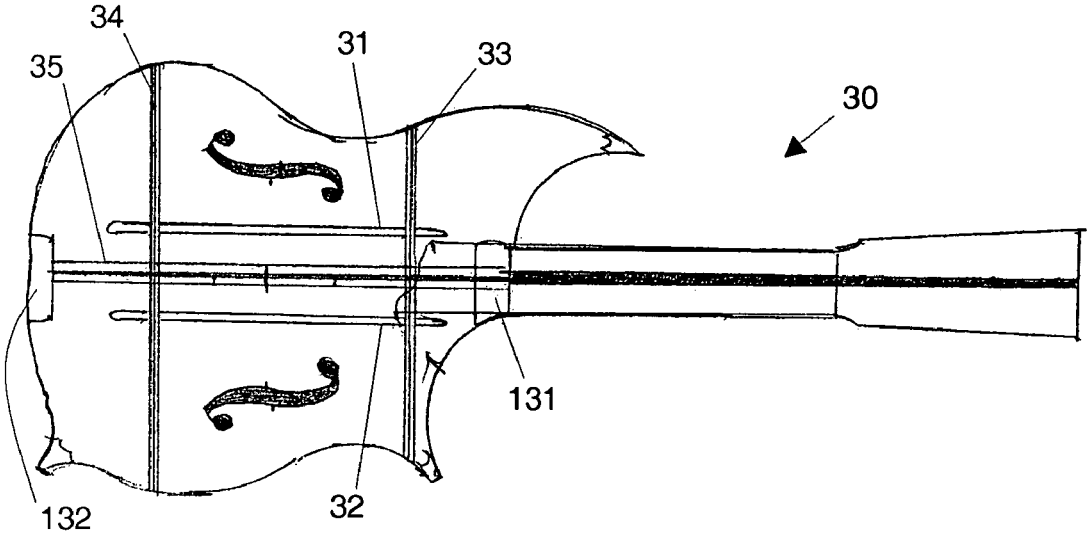
FIG. 17 is a top view drawing of the mandolin of FIG. 16.
Figure 18:
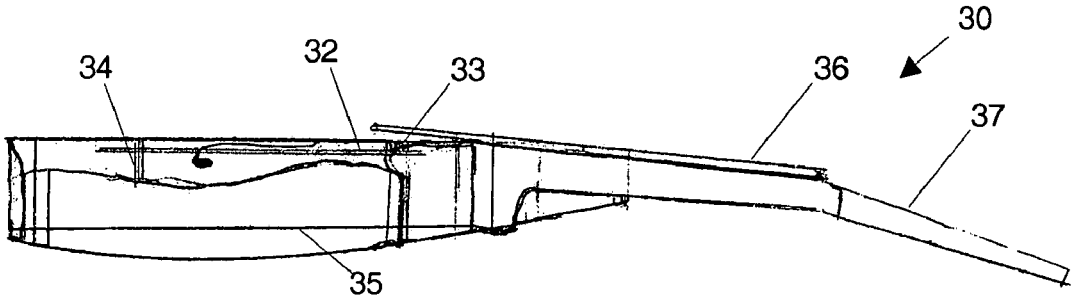
FIG. 18 is a right-side view drawing of the mandolin of FIGS. 16 and 17.

A mandolin 30 is shown in FIGS. 16–18. Like the cutaway guitar 40 of FIG. 4, the body of the mandolin 30 is asymmetric, as if a portion of the body adjacent to the neck 36 were moved from one half to the other. The mandolin 30 is shown with a single bass tone bar 31 and a single treble tone bar 32, both preferably made of spruce, although any suitable tone bar configuration may be used. The upper transverse brace 33 and lower transverse brace 34 are scalloped, similar to those in the violin 1. The longitudinal brace 35, along with the two transverse braces, preferably uses a laminated structure, with an ebony core surrounded by spruce. There is a neck block 131 and a lower block 132. Illustratively, the neck 36 is connected to the body at an angle of about 5°, and the head stock 37 and the neck are connected at an angle of about 13.5°.

I believe that the elements described herein produce a richer set of harmonics, and therefore produce a fuller, more pleasing tone in the instrument. Most of these harmonics are produced by the strings themselves, and are amplified by resonant regions of the instrument. I believe that the elements described herein create many more such resonant regions that found in known instruments. It should be noted that if a string vibrated only with a single frequency, then the output from the instrument would be only the single frequency.

One way to think about the resonant patterns of the instrument bodies is in terms of a known technique in which a test station is used to excite the instrument body with a sine wave tone at a particular frequency, and examine the response of the instrument body. The portions of the instrument body that do not oscillate form a "node", and the nodal patterns at particular frequencies provide information about the overall response of the instrument to particular frequencies. In general, because any stringed instrument has a rather complex shape, the instrument will have a large number of natural resonances arising from multiple surfaces and a cavity between them, starting from about 100 Hz for a guitar, up well past 1 KHz. These natural resonances have a wide variety of locations (i.e., resonant frequencies) and intensities (i.e., how strong a resonance it is).

Concentrating a substantial portion of the mass of the back plate to its spine has a significant impact on the natural resonances. In the common style of instrument in which the back plate may have a reinforced joint but does not have a spine, the back plate and the rib play a structural role, supporting the top plate. One might think of the rib as an "anchor", with little oscillation occurring at the outer perimeter of the instrument. In contrast, the back plate described herein has a substantial portion of its mass located at the spine. Here, the spine acts as an "anchor" for the rest of the instrument, with numerous oscillations occurring throughout the rest of the instrument. These new oscillation patterns are different in character from the well-known oscillation patterns. A larger oscillation at the rib itself may produce more oscillation of the outer body of the instrument, leading to more sound given off by the instrument body in all directions, leading finally to a more omidirectional sound produced by the instrument. In particular, if the harmonics produced by a particular note give more oscillation at the outer instrument body, then the harmonics will be heard more loudly in all directions from the instrument. In general, this is a good thing, and gives a more complex, pleasing tone to the instrument.

Another aspect of the instruments described herein contributes both to their harmonic production as well as their omnidirectionality. I believe that in general, two similar but not identical structures in proximity are useful for producing rich harmonics. As an example, consider a concert hall with fine acoustics. Standing on the stage are a pair of excellent musicians, each playing the same piece on a high-quality guitar of the common type. As the musicians play, the sounds from one guitar produce harmonics in the other guitar, and vice versa. A listener in the audience perceives a richness in the sound that is normally not present from one guitar alone. The guitars, as carefully as they may be constructed and tuned, still have finite differences between them, be it in material thickness or spacing, or variations in density, and so forth. I believe that this subtle difference between the instruments contributes to the overall richness in tone produced by the combination of guitars, which one does not hear from a single guitar of the common type, regardless of how carefully the common guitar is crafted.

The harmonics produced by the two guitars on stage are heard differently in the audience, depending on where the listener is seated. There is a spatial dependence to the harmonics, meaning that there may be seats where the full harmonics are heard clearly, and there may be other seats where the harmonics are less clearly heard. This variation from seat-to-seat is undesirable. Furthermore, it is found that if the two musicians move farther apart on the stage, then there is more spatial dependence to the harmonics, or more seat-to-seat variation in how the harmonics are perceived. One finds that the amount of (undesirable) spatial dependence of the harmonics is inversely proportional to the distance between the two structures that created them.

The quality of rich harmonics that are produced by the pair of common-type instruments may be produced by a single instrument that has a substantial longitudinal brace bisecting the back plate. In essence, the brace separates the back plate inside the instrument into two structures, which are very close in properties such as volume and resonances, but which are not quite identical as a practical matter. Alternatively, the structures may be related along the diatonic scale, as by thirds or fifths. These two similar structures inside the instrument combine to produce a rich set of harmonics—the same quality of harmonics heard from two common-type instruments, but produced from a single instrument. A listener seated in the audience will hear these rich harmonics, and may think that it is coming from a pair of instruments. This is a substantial advantage of the instruments discussed herein over common instruments.

Furthermore, the rich harmonics produced by the single instrument have very little spatial dependence. The two structures are directly adjacent to each other, separated only by the thickness of the longitudinal brace. Because the two structures are so close, the spatial variation of the produced harmonics is extremely small. In other words, there is hardly any seat-to-seat variation of the harmonics, which sound essentially the same regardless of where the listener is sitting. This lack of spatial variation of the produced harmonics may be referred to as "filling the room". Because the harmonics from the instruments discussed herein adequately fill the room, the instruments may even overcome the inadequacies of a poorly designed concert hall. This, too, is a substantial advantage of the instruments discussed herein.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A stringed musical instrument comprising:

a body comprising:

a first plate;

a second plate; and a rib coupling the first and second plates to form a cavity enclosed by the first and second plates and by the rib;

wherein the second plate comprises:

a concentrated mass continuously extending across the second plate between a first section of the rib and a second section of the rib, and having ends in proximity to respectively the first and second rib sections;

a first distributed mass extending from the concentrated mass to a third section of the rib between the first and second rib sections; and a second distributed mass extending from the concentrated mass to a fourth section of the rib between the first and second rib sections, the first rib section being between the third and fourth rib sections, and the second rib section being between the third and fourth rib sections;

a plurality of strings; and a bridge acoustically coupling the strings to one of the first and second plates;

wherein the second plate comprises a sheet of wood of a first density; and wherein the concentrated mass comprises a first strip of wood secured to the wood sheet, the first wood strip being continuous and extending across the wood sheet between the first rib section and the second rib section, the first wood strip having a second density greater than the first density.

2. The stringed musical instrument of claim 1 further comprising:

a first block disposed at the first rib section and affixed to the first rib section and to the first and second plates; and a second block disposed at the second rib section and affixed to the second rib section and to the first and second plates;

wherein the concentrated mass further comprises:

a second strip of wood; and a third strip of wood;

the second and third wood strips having a third density less than the first density and less than the second density; and the first, second and third strips of wood forming a laminated structure secured to the wood sheet and having one end secured to the first block and a second end secured to the second block.

3. A stringed musical instrument comprising:

a body comprising:

a first plate;

a second plate; and a rib coupling the first and second plates to form a cavity enclosed by the first and second plates and by the rib;

wherein the second plate comprises:

a concentrated mass continuously extending across the second plate between a first section of the rib and a second section of the rib, and having ends in proximity to respectively the first and second rib sections;

a first distributed mass extending from the concentrated mass to a third section of the rib between the first and second rib sections; and a second distributed mass extending from the concentrated mass to a fourth section of the rib between the first and second rib sections, the first rib section being between the third and fourth rib sections, and the second rib section being between the third and fourth rib sections;

the first and second distributed masses being essentially equal and symmetrical about the concentrated mass;

a plurality of strings; and a bridge acoustically coupling the strings to one of the first and second plates.

4. A stringed musical instrument comprising:

a body comprising:

a first plate;

a second plate; and a rib coupling the first and second plates to form a cavity enclosed by the first and second plates and by the rib;

wherein the second plate comprises:

a concentrated mass continuously extending across the second plate between a first section of the rib and a second section of the rib, and having ends in proximity to respectively the first and second rib sections;

a first distributed mass extending from the concentrated mass to a third section of the rib between the first and second rib sections; and a second distributed mass extending from the concentrated mass to a fourth section of the rib between the first and second rib sections, the first rib section being between the third and fourth rib sections, and the second rib section being between the third and fourth rib sections;

the first and second distributed masses being unequal and tuned to respective tones of a diatonic scale;

a plurality of strings; and a bridge acoustically coupling the strings to one of the first and second plates.

5. A stringed musical instrument comprising:

a body comprising:

a first plate;

a second plate; and a rib coupling the first and second plates to form a cavity enclosed by the first and second plates and by the rib;

wherein the second plate comprises:

a concentrated mass continuously extending across the second plate between a first section of the rib and a second section of the rib, and having ends in proximity to respectively the first and second rib sections;

a first distributed mass extending from the concentrated mass to a third section of the rib between the first and second rib sections; and a second distributed mass extending from the concentrated mass to a fourth section of the rib between the first and second rib sections; the first rib section being between the third and fourth rib sections, and the second rib section being between the third and fourth rib sections;

a plurality of strings; and a bridge acoustically coupling the strings to one of the first and second plates;

wherein the musical instrument has a longitudinal axis;

wherein the first plate is elongated along a first line parallel to the longitudinal axis;

wherein the second plate is elongated along a second line parallel to the longitudinal axis; and wherein the concentrated mass is elongated along the second line.

6. The stringed musical instrument of claim 5 further comprising:

a first stress distributing structure disposed at a first end of the concentrated mass and secured to the first plate, the second plate, and the first section of the rib; and a second stress distributing structure disposed at a second end of the concentrated mass and secured to the first plate, the second plate, and the second section of the rib.

7. The stringed musical instrument of claim 6 further comprising:

a neck securely coupled to the concentrated mass of the second plate, the neck having a fingerboard thereon and a head at an end thereof;

wherein the strings run along the fingerboard and are acoustically coupled to the first plate by the bridge; and wherein the strings comprise first and second ends, the first ends being secured to the first plate, and the second ends being secured to the head.

8. The stringed musical instrument of claim 6 wherein:

a first stress distributing structure comprises a first block; and a second stress distributing structure comprises a second block.

9. A stringed musical instrument comprising:

a body comprising:

a first plate;

a second plate; and a rib coupling the first and second plates to form a cavity enclosed by the first and second plates and by the rib;

wherein the second plate comprises an elongated supportive portion extending across the second plate between a first section of the rib and a second section of the rib, and having ends in proximity to respectively the first and second rib sections;

wherein portions of the second plate disposed away from the elongated supportive portion, the first plate, and the rib are all capable of sustained vibration over a broad spectrum of resonance modes; and wherein the supportive portion supports a low order resonance mode across the second plate;

a plurality of strings; and a bridge acoustically coupling the strings to one of the first and second plates.

10. A stringed musical instrument comprising:

a body comprising:

a first plate;

a second plate; and a rib coupling the first and second plates to form a cavity enclosed by the first and second plates and by the rib;

wherein the second plate comprises an elongated supportive portion extending across the second plate between a first section of the rib and a second section of the rib, and having ends in proximity to respectively the first and second rib sections; and wherein portions of the second plate disposed away from the elongated supportive portion, the first plate, and the rib are all capable of sustained vibration over a broad spectrum of resonance modes;

a plurality of strings; and a bridge acoustically coupling the strings to one of the first and second plates;

wherein the second plate further comprises:

a sheet of wood of a first density;

a concentrated mass continuously extending across the second plate between a first section of the rib and a second section of the rib and comprising a laminated wood body secured to the wood sheet, the laminated wood body comprising a continuous wood strip extending across the wood sheet between the first rib section and the second rib section, the wood strip having a second density greater than the first density;

a first distributed mass extending from the concentrated mass to a third section of the rib between the first and second rib sections; and a second distributed mass extending from the concentrated mass to a fourth section of the rib between the first and second rib sections, the first rib section being between the third and fourth rib sections, and the second rib section being between the third and fourth rib sections.

11. A stringed musical instrument comprising:

a body comprising:

a first plate;

a second plate; and a rib coupling the first and second plates to form a cavity enclosed by the first and second plates and by the rib;

wherein the second plate comprises an elongated supportive portion extending across the second plate between a first section of the rib and a second section of the rib, and having ends in proximity to respectively the first and second rib sections; and wherein portions of the second plate disposed away from the elongated supportive portion, the first plate, and the rib are all capable of sustained vibration over a broad spectrum of resonance modes;

a plurality of strings;

a bridge acoustically coupling the strings to one of the first and second plates;

a first stress distributing structure disposed at a first end of the concentrated mass and secured to the first plate, the second plate, and the first section of the rib; and a second stress distributing structure disposed at a second end of the concentrated mass and secured to the first plate, the second plate, and the second section of the rib;

wherein first and second portions of the second plate are disposed on opposite sides of the supportive portion; and the first and second portions are essentially equal and symmetrical about the supportive portion.

12. A stringed musical instrument comprising:

a body comprising:

a first plate;

a second plate; and a rib coupling the first and second plates to form a cavity enclosed by the first and second plates and by the rib;

wherein the second plate comprises an elongated supportive portion extending across the second plate between a first section of the rib and a second section of the rib, and having ends in proximity to respectively the first and second rib sections; and wherein portions of the second plate disposed away from the elongated supportive portion, the first plate, and the rib are all capable of sustained vibration over a broad spectrum of resonance modes;

a plurality of strings;

a bridge acoustically coupling the strings to one of the first and second plates;

a first stress distributing structure disposed at a first end of the concentrated mass and secured to the first plate, the second plate, and the first section of the rib; and a second stress distributing structure disposed at a second end of the concentrated mass and secured to the first plate, the second plate, and the second section of the rib;

wherein first and second portions of the second plate are disposed on opposite sides of the supportive portion; and the first and second portions of the second plate are unequal and tuned to respective tones of a diatonic scale.

13. A stringed musical instrument comprising:

a body comprising:

a first plate curved to form a first generally convex surface having a first crest line and a first generally concave surface;

a second plate curved to form a second generally convex surface having a second crest line and a second generally concave surface; and a rib coupling the first and second plates to form a cavity enclosed by the first and second generally concave surfaces and by the rib, the first crest line being transverse to the second crest line;

a plurality of strings; and a bridge acoustically coupling the strings to one of the first and second plates.

14. The stringed musical instrument of claim 13 wherein:

the musical instrument has a longitudinal axis generally parallel to the strings;

the first plate has a generally cylindrical curvature, the first crest line being generally parallel to the longitudinal instrument axis; and the second plate has a generally cylindrical curvature, the second crest line being generally perpendicular to the longitudinal instrument axis.

15. The stringed musical instrument of claim 14 wherein the first and second crest lines are generally curved.

16. The stringed musical instrument of claim 14 wherein the first and second crest lines are generally straight.

17. The stringed musical instrument of claim 13 wherein:

the musical instrument has a longitudinal axis generally parallel to the strings;

the first plate comprises a playing table;

the hole is in the playing table;

the playing table has a generally cylindrical curvature, the first crest line being generally straight and generally parallel to the longitudinal instrument axis;

the second plate comprises a back plate; and the back plate has a generally cylindrical curvature, the second crest line being generally straight and generally perpendicular to the longitudinal instrument axis.

18. A stringed musical instrument comprising:

a body comprising:

a first plate;

a second plate;

a rib coupling the first and second plates to form a cavity enclosed by the first and second plates and by the rib; and a brace extending across a portion of the first plate within the cavity, the brace having a plurality of interspersed projecting sections along an edge thereof and being secured to the first plate by the projecting sections, wherein portions of the edge between the projecting sections are spaced away from the first plate, wherein the projecting sections of the edge have a first cumulative area, and wherein the spaced-away portions of the edge have a second cumulative area that exceeds the first cumulative area;

a plurality of strings; and a bridge acoustically coupling the strings to one of the first and second plates.

19. A stringed musical instrument as in claim 18 wherein the edge of the brace is scalloped.

20. A stringed musical instrument having a longitudinal axis and comprising:

an elongated body having a neck end and a bottom end and comprising:

a playing table comprising a first sheet of wood of generally a first predetermined density having a generally cylindrical curvature to form a first generally convex surface having a first substantially straight crest line and a first generally concave surface, the first crest line being generally parallel to the longitudinal instrument axis;

a back having a generally cylindrical curvature to form a second generally convex surface having a second substantially straight crest line and a second generally concave surface, the second crest line being generally perpendicular to the longitudinal instrument axis;

a rib glued to the first and second plates at respective undulating seams to form a cavity enclosed by the first and second generally concave surfaces and by the rib, the playing table having a hole into the cavity;

a neck block disposed at the neck end of the elongated body and glued to the playing table, the back, and the rib;

a bottom block disposed at the bottom end of the elongated body and glued to the playing table, the back, and the rib; and a playing table brace glued to and extending across a portion of the playing table within the cavity, the first playing table brace having a scalloped edge in contact with the playing table and extending across the playing table in conformance with the curvature thereof and perpendicular to the first crest line;

wherein the back comprises:

a second sheet of wood of generally a second predetermined density greater than the first density; and a back brace glued to and extending entirely across the second sheet of wood in conformance with the curvature of the back and within the cavity, the back brace being and perpendicular to the second crest line and having an edge in continuous contact with the back and in conformance with the curvature of the back, and the back brace being a laminated material having a continuous core of a third density greater than the second density;

a neck glued to the neck block and acoustically coupled to the back brace, the neck having a fingerboard thereon and a head stock at an end thereof;

a plurality of strings having first and second ends, the first ends of the strings being mechanically coupled to the playing table and the second ends of the strings running along the fingerboard and being mechanically coupled to the head stock; and a bridge acoustically coupling the strings to the playing table.

21. The stringed musical instrument of claim 20 wherein the musical instrument is a guitar.

22. The stringed musical instrument of claim 20 wherein the musical instrument is a violin, viola, violincello or bass violin/viol.

23. The stringed musical instrument of claim 20 wherein the musical instrument is a mandolin.

* * * * *

UNITED STATES PATENT AND TRADEMARK OFFICE

CERTIFICATE OF CORRECTION

PATENT NO. : 7,166,788 B2
APPLICATION NO. : 11/034167
DATED : January 23, 2007
INVENTOR(S) : Kevin Alexander Wyman It is certified that error appears in the above-identified patent and that said Letters Patent is hereby corrected as shown below:

Title Page, Item (76) after "Inventor: Kevin Alexander Wyman," replace "2248 N. 74th Way, Scottsdale, AZ (US) 85257" with --2246 N. 74th Way, Scottsdale, AZ (US) 85257--.

Signed and Sealed this

First Day of January, 2008

JON W. DUDAS
*Director of the United States Patent and Trademark Office*